US006270274B1

(12) United States Patent
Chao

(10) Patent No.: US 6,270,274 B1
(45) Date of Patent: Aug. 7, 2001

(54) PEN FOR RECEIVING EYEGLASSES

(76) Inventor: David Chao, 1120 Green Acre Rd., Towson, MD (US) 21204

( * ) Notice: Subject to any disclaimer, the term of this patent is extended or adjusted under 35 U.S.C. 154(b) by 0 days.

(21) Appl. No.: 09/607,265

(22) Filed: Jun. 30, 2000

(51) Int. Cl.[7] ..... B43K 29/00
(52) U.S. Cl. ..... 401/195; 401/52
(58) Field of Search ..... 401/195, 52, 109–112, 401/116, 64, 68

(56) References Cited

U.S. PATENT DOCUMENTS

| | | | | |
|---|---|---|---|---|
| D. 260,905 | | 9/1981 | Klaber . | |
| 2,060,406 | | 11/1936 | Tiede . | |
| 2,624,011 | | 12/1952 | Stern . | |
| 2,772,772 | | 12/1956 | Taylor . | |
| 3,549,005 | | 12/1970 | Kalogris . | |
| 3,768,634 | | 10/1973 | Creevy . | |
| 4,149,812 | | 4/1979 | Huffmann, Jr. . | |
| 4,336,882 | * | 6/1982 | Sakwa | 401/195 |
| 5,009,535 | * | 4/1991 | Oilar | 401/195 |
| 5,929,967 | * | 7/1999 | Conner | 351/158 |
| 5,949,515 | | 9/1999 | Hoshino . | |
| 6,004,597 | | 12/1999 | Coleman et al. . | |

* cited by examiner

*Primary Examiner*—J. Casimer Jacyna
*Assistant Examiner*—Tuan Nguyen
(74) *Attorney, Agent, or Firm*—Harness, Dickey & Pierce, P.L.C.

(57) ABSTRACT

A pen for receiving eyeglasses includes a pen barrel and a writing tip unit. The pen barrel includes a barrel body which is adapted to receive a pair of eyeglasses therein, and which has open front and rear ends, and a fixed rear cap which is mounted fixedly on and which closes the rear end of the barrel body. The writing tip unit includes an openable front cap which has a front end and a rear end that is attached to and that closes the front end of the barrel body, and a writing tip which is confined within the front cap and which extends from the front end of the front cap.

21 Claims, 7 Drawing Sheets

PEN FOR RECEIVING EYEGLASSES

BACKGROUND OF THE INVENTION

1. Field of the Invention

The present invention relates to a pen for receiving eyeglasses, more particularly to a pen having a fixedly mounted rear cap, and an openable front cap with a writing tip, which permits access to an interior of a pen barrel for storage of eyeglasses.

2. Description of the Related Art

Many people wear eyeglasses only on certain occasions. For instance, people suffering from presbyopia usually wear eyeglasses only for reading and close work, such as writing. Manufacturers have therefore developed a type of pen that has a receiving space for storing a pair of eyeglasses.

U.S. Pat. No. 5,929,967 teaches a pen for receiving eyeglasses, which includes a hollow pen barrel having a first open end and a second open end. The first open end is provided with a writing tip unit, while the second open end has a removable cap mounted pivotally thereon to allow access to an interior of the pen barrel for storage of a pair of eyeglasses from the rear end of the pen. While the pivotally connected rear cap can be prevented from loss, such pivotal connection obstructs addition of other accessories, such as a flashlight, to the rear end of the pen. On the other hand, the structure of the rear cap may be weakened by any additional accessory mounted thereon. If the flashlight and the writing tip unit are mounted interchangeably at the front end of the pen, they are inconvenient to carry around and can be misplaced easily. Besides, it is comparatively complicated to provide two removable components at the two ends of the pen in terms of manufacture.

SUMMARY OF THE INVENTION

Therefore, the main object of the present invention is to provide a pen for receiving eyeglasses, which overcomes the aforesaid problems.

Accordingly, a pen for receiving eyeglasses of the present invention includes a pen barrel and a writing tip unit. The pen barrel includes a barrel body which is adapted to receive a pair of eyeglasses therein, and which has open front and rear ends, and a fixed rear cap which is mounted fixedly on and which closes the rear end of the barrel body. The writing tip unit includes an openable front cap which has a front end and a rear end that is attached to and that closes the front end of the barrel body, and a writing tip which is confined within the front cap and which extends from the front end of the front cap.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1A:
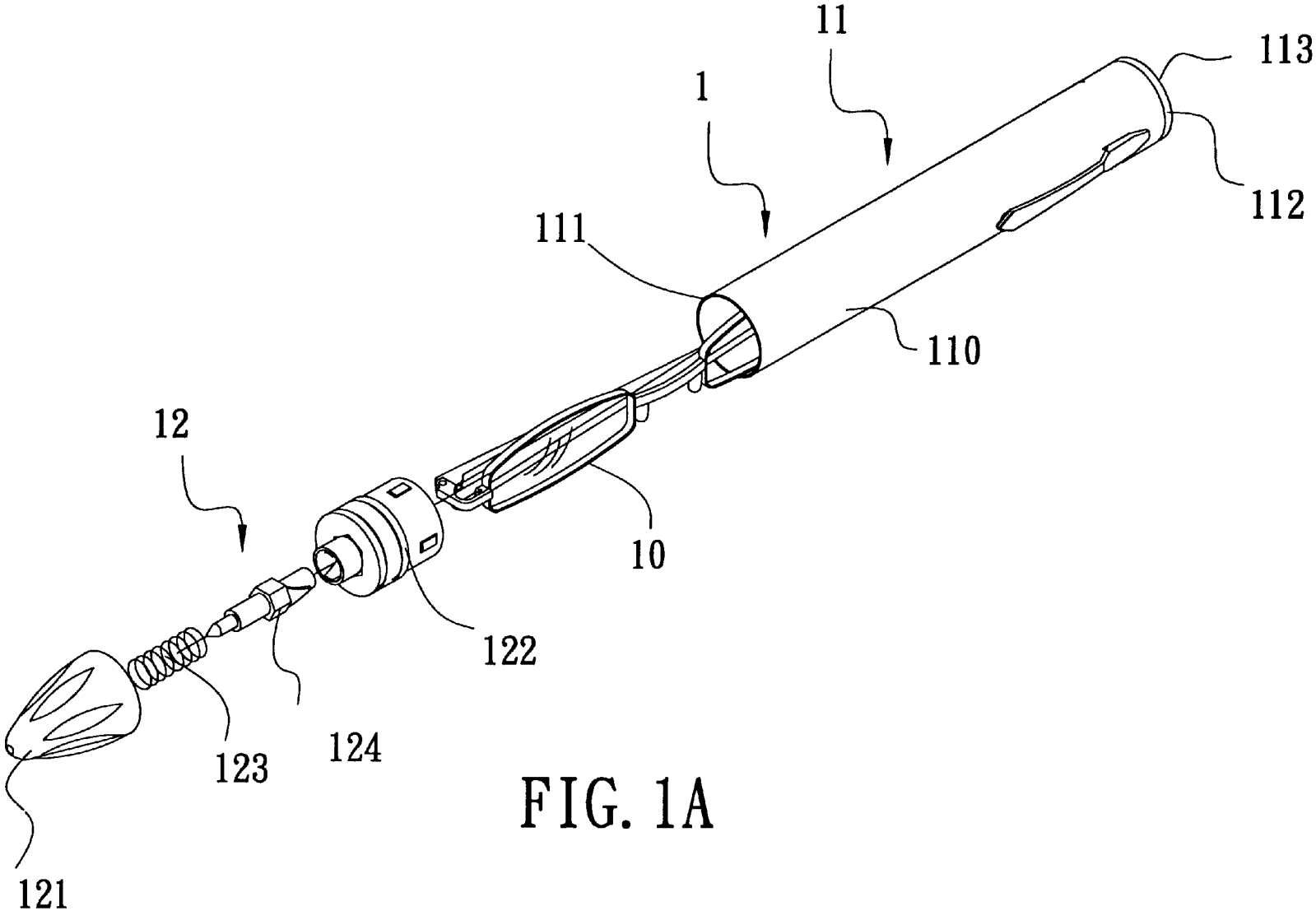
FIG. 1A is a partly exploded perspective view of the first preferred embodiment of a pen for receiving eyeglasses according to the invention.

Before the present invention is described in greater detail, it should be noted that like elements are denoted by the same reference numerals throughout the disclosure.

Figure 1B:
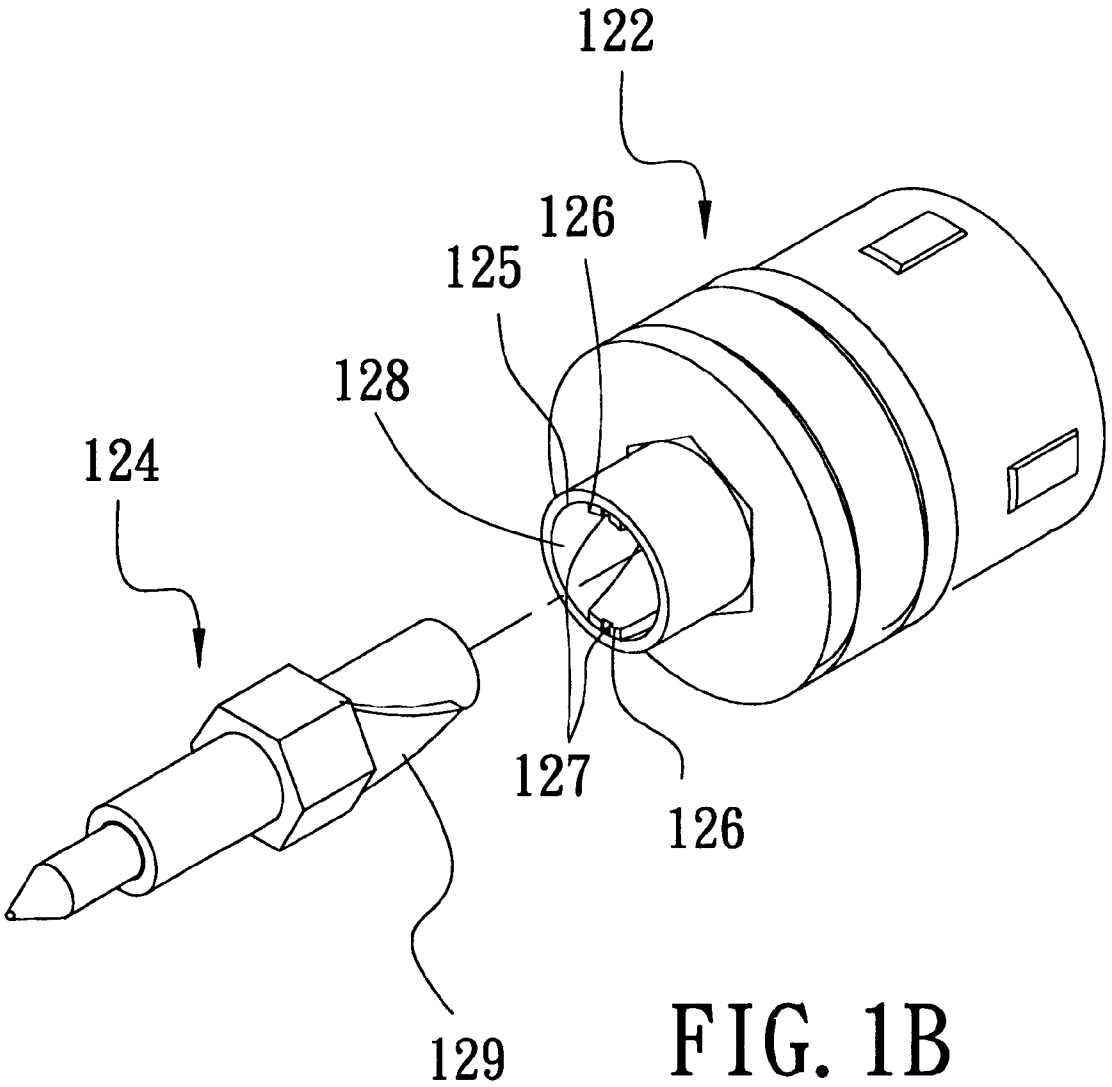
FIG. 1B is an exploded perspective view of a writing tip and a connecting block of the first preferred embodiment.

Referring to FIGS. 1A and 1B, the first preferred embodiment of a pen 1 for receiving eyeglasses according to the present invention is shown to include a pen barrel 11 and a writing tip unit 12. The pen barrel 11 includes a barrel body 110 which is adapted to receive a pair of eyeglasses 10 therein, and which has open front and rear ends 111, 112, and a fixed rear cap 113 which is mounted fixedly on and which closes the rear end 112 of the barrel body 10. The rear cap 113 is press fitted within the rear end 112 of the barrel body 110 such that it cannot be removed from the barrel body 110.

The writing tip unit 12 includes an openable front cap and a writing tip 124. The front cap includes a hollow rotary knob 121 and a connecting block 122 that is attached to and that closes the front end 111 of the barrel body 110. The rotary knob 121 and the connecting block 122 are interengaged such that the rotary knob 121 can rotate relative to the connecting block 122. The connecting block 122 has a front end formed with a cylindrical tip mounting portion 125. The tip mounting portion 125 has an inner surface formed with two opposed, substantially trapezoidal projections 126 such that two substantially triangular recesses 128 are defined therebetween. Each projection 126 has a front end surface formed with a limiting depressed portion 127. The writing tip 124 has a front end portion fitted with a spring 123 for biasing the writing tip 124 to a retracted position, and has a rear end portion provided with two opposed, substantially triangular abutting protrusions 129 that fit into the recesses 128. The connecting block 122 is press fitted within the front end 111 of the barrel body 110 for synchronous rotation therewith, whereas the writing tip 124 is coupled with the rotary knob 121 in a known manner for synchronous rotation therewith. As such, when the rotary knob 121 rotates relative to the barrel body 110 against the biasing action of the spring 123, the writing tip 124 will rotate relative to the connecting block 122, while the abutting protrusions 129 thereof will be pushed by inclined side walls of the recesses 128 until the abutting protrusions 129 are confined by the limiting depressed portions 127. At this time, the writing tip 124 will extend from a front end of the rotary knob 121 for writing purposes. Thereafter, the rotary knob 121 may be rotated to cause the abutting protrusions 129 to displace to the recesses 128 by virtue of the biasing action of the spring 123 so that the writing tip 124 retracts into the rotary knob 121.

When it is desired to stow the eyeglasses 10 in the pen barrel 11 of the pen 1, it is only necessary to remove the writing tip unit 12 from the pen barrel 11 to allow insertion of the eyeglasses 10 via the front end 111 into the barrel body 110. As such, the user may carry the pen 1 around with the eyeglasses 10 stowed thereinside, and may remove the eyeglasses 10 from the pen 1 in a convenient manner any time.

Figure 1D:
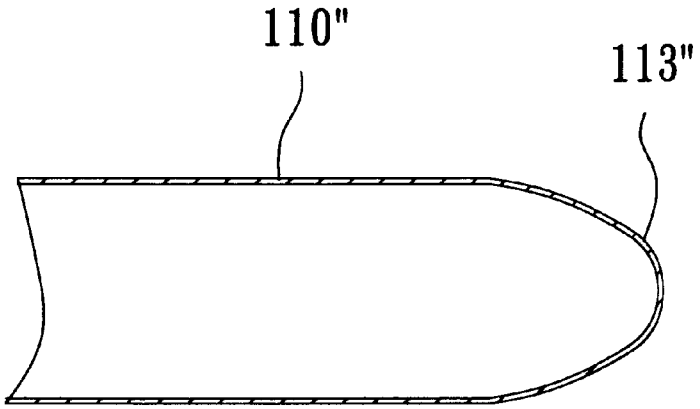
FIG. 1D is a fragmentary sectional view illustrating a rear cap integrally formed with a barrel body of the third preferred embodiment of a pen for receiving eyeglasses according to the invention.
Figure 1C:
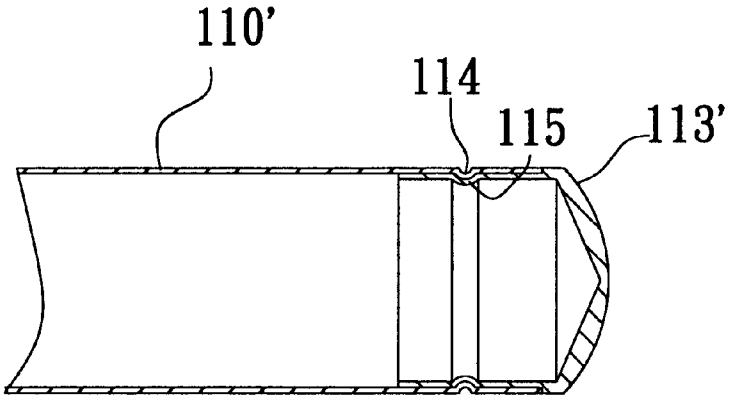
FIG. 1C is a fragmentary sectional view illustrating engagement of a rear cap and a barrel body of the second preferred embodiment of a pen for receiving eyeglasses according to the invention.

Referring to FIG. 1C, in the second preferred embodiment, an outer surface of the rear cap 113' is formed with an annular groove 114. The barrel body 110' is sleeved on the rear cap 113', and has an inner surface formed with an annular projection 115 that engages fittingly the annular groove 114 in the rear cap 113', thereby retaining the rear cap 113' on the barrel body 110'.

With reference to FIG. 1D, in the third preferred embodiment, the rear cap 113" may be formed integrally with the barrel body 110".

Figure 2:
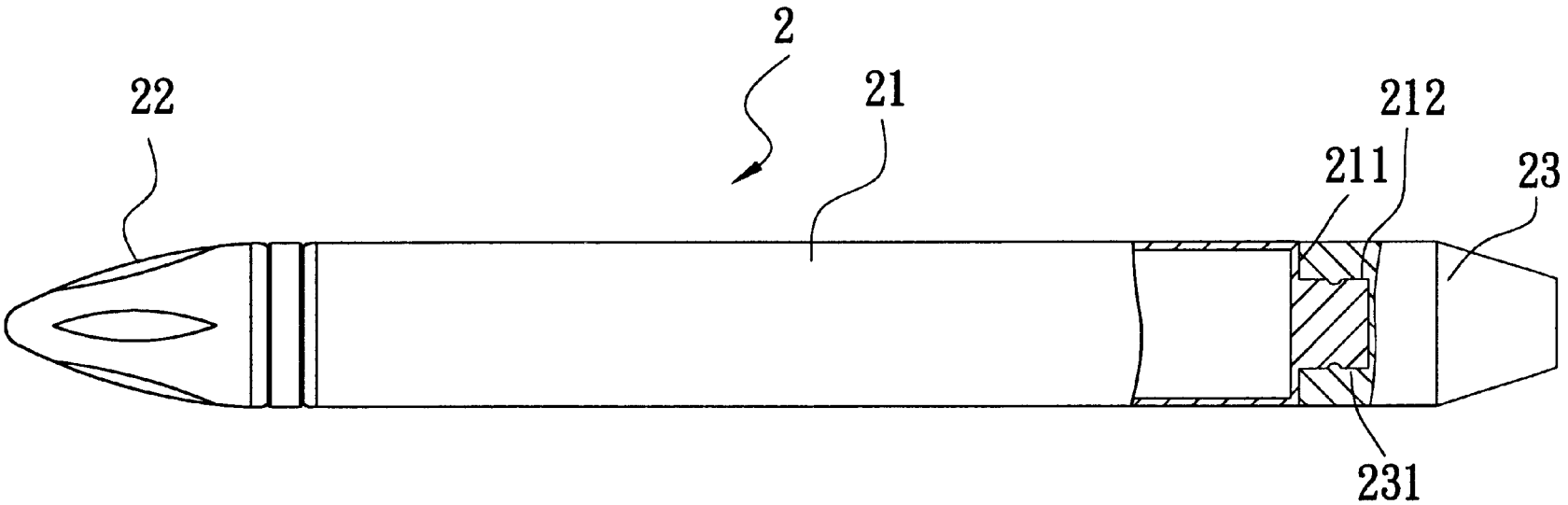
FIG. 2 is a partly sectional view of the fourth preferred embodiment of a pen for receiving eyeglasses according to the invention.

Referring to FIG. 2, the fourth preferred embodiment of a pen 2 according to the present invention is shown to include a pen barrel 21 and a writing tip unit 22. A fixed rear cap 211 is mounted fixedly on and closes a rear end of the pen barrel 21. This embodiment is different from the first preferred embodiment in that a rear end of the rear cap 211 extends rearwardly to form a retaining block 212, and a flashlight 23 is mounted fixedly on the retaining block 212 in such a manner that the retaining block 212 is press fitted within a blind hole 231 in the flashlight 23. Hence, the pen 2 may have an additional lighting function. It should be appreciated that since the flashlight 23 is provided on the rear cap 211 that is mounted fixedly on the rear end of the pen barrel 2, the structure of the pen 2 is relatively strong.

Figure 3:
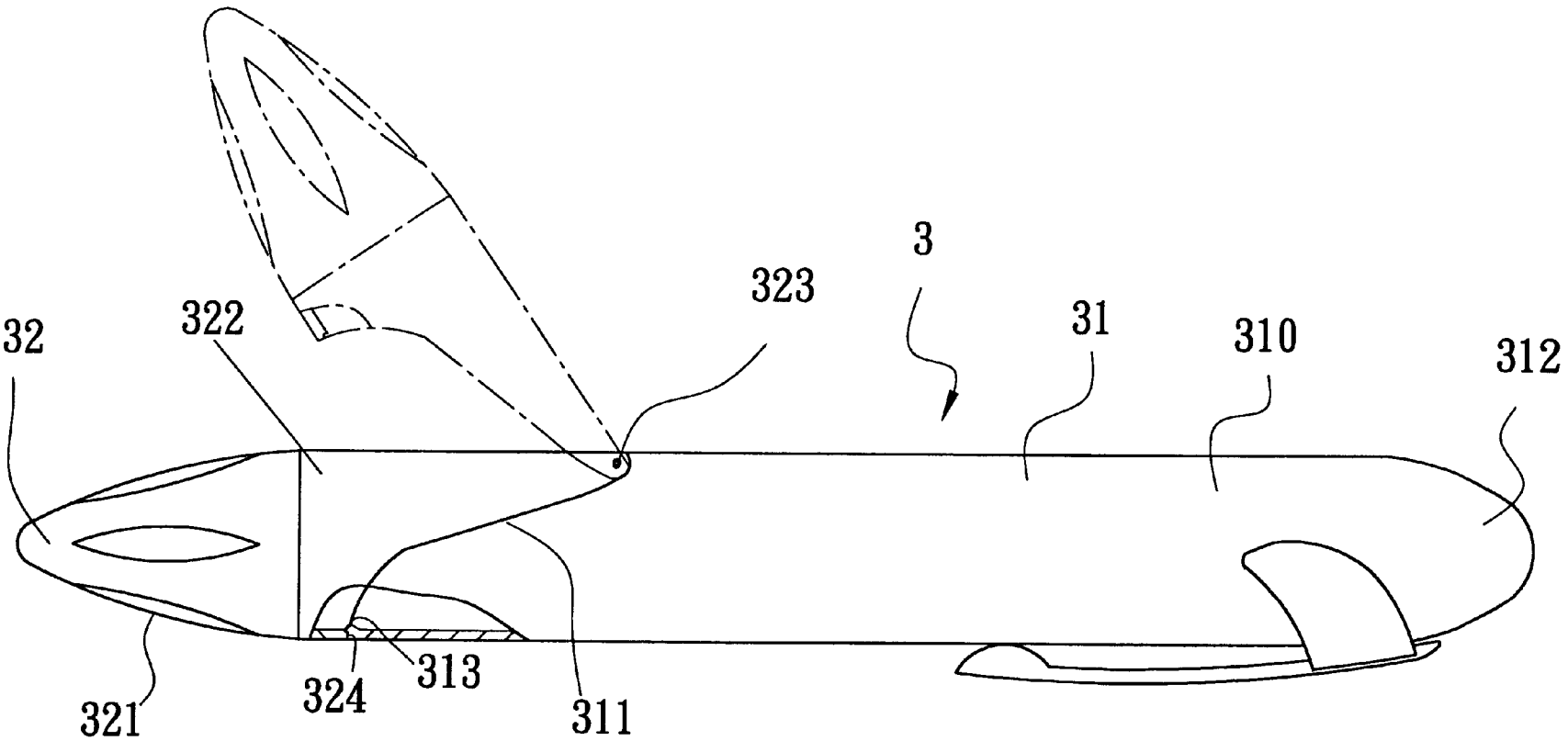
FIG. 3 is partly sectional view of the fifth preferred embodiment of a pen for receiving eyeglasses according to the invention.

Referring to FIG. 3, the fifth preferred embodiment of a pen 3 according to the present invention is shown to include a pen barrel 31 and a writing tip unit 32. Likewise, the writing tip unit 32 includes an openable front cap constituted by a rotary knob 321 and a connecting block 322, and a writing tip (not shown). The pen barrel 31 has a barrel body 310 with an open front end 311 and a rear cap 312 integrally formed with the barrel body 310. This embodiment is different from the first preferred embodiment in that the writing tip unit 32 is formed with a retaining edge 324, whereas the pen barrel 31 is formed with a retaining edge 313 that engages the retaining edge 324 of the writing tip unit 32, thereby positioning the writing tip unit 32 on the pen barrel 31. In addition, the writing tip unit 32 is mounted rotatably on the pen barrel 31 via a pivot portion 323 and is rotatable about an axis, which is perpendicular to the barrel body 310, for opening and closing the front end 311 of the barrel body 310. In this embodiment, since the writing tip unit 32 is mounted pivotally on the pen barrel 31, it remains attached to the pen barrel 31 when lifted to permit access to the interior of the barrel body 310.

Figure 4A:
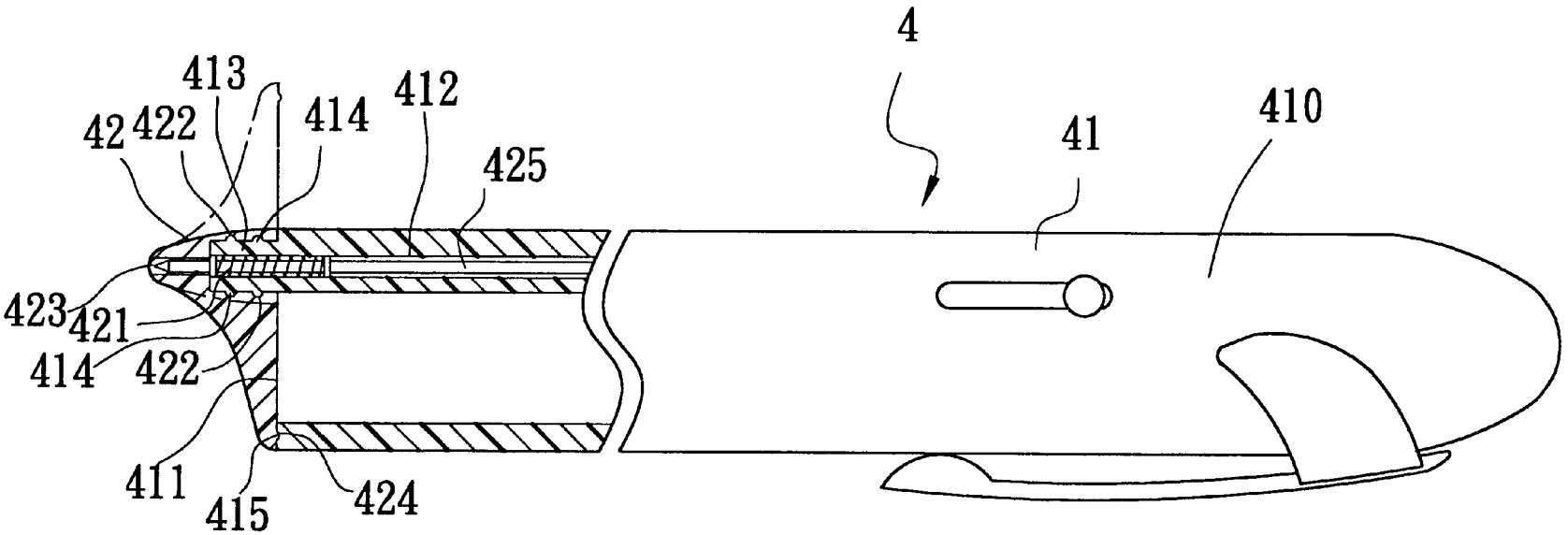
FIG. 4A is a partly sectional view of the sixth preferred embodiment of a pen for receiving eyeglasses according to the invention.

With reference to FIG. 4A, the sixth preferred embodiment of a pen 4 according to the present invention is shown to include a pen barrel 41 with a barrel body 410 and an open front end 411, and an openable front cap 42. This embodiment differs from the fifth preferred embodiment in that the front cap 42 has a rear end surface with an outer peripheral portion formed with a pivot hole 421, and an inner surface formed with two parallel annular grooves 422 in communication with the pivot hole 421. The barrel body 410 has a front end surface which includes an axially extending pivot pin 413 that extends integrally and forwardly therefrom, and that engages fittingly the pivot hole 421 in the front cap 42. The pivot pin 413 has an outer surface formed with two annular projections 414 that engage respectively and fittingly the annular grooves 422 in the front cap 42, whereby the front cap 42 can rotate about the pivot pin 413 along an axis that is parallel to the barrel body 410 for opening and closing of the front end 411 of the barrel body 410. In order to secure the front cap 42 on the front end 411 of the barrel body 410, the front cap 42 is provided with a boss 424 projecting therefrom and distal to the pivot pin hole 421, and the front end 411 of the pen barrel 41 is provided with an indentation 415 for engaging the boss 424 when the front cap 42 is rotated to a closed position. In addition, an axially extending cylindrical hole 412 is formed in the barrel body 410 to extend through the pivot pin 413. The front cap 42 further includes a through tip hole 423 that is communicated with the pivot pin hole 421 such that a writing instrument 425, such as a refill, can be accommodated in the hole 412 to extend through the pivot pin hole 421 and to project from the tip hole 423 for writing purpose. Compared with the above-described preferred embodiments, the writing instrument 425 is accommodated in both of the barrel body 410 and the front cap 42, and is of a longer length to make possible a longer period of writing.

Figure 4B:
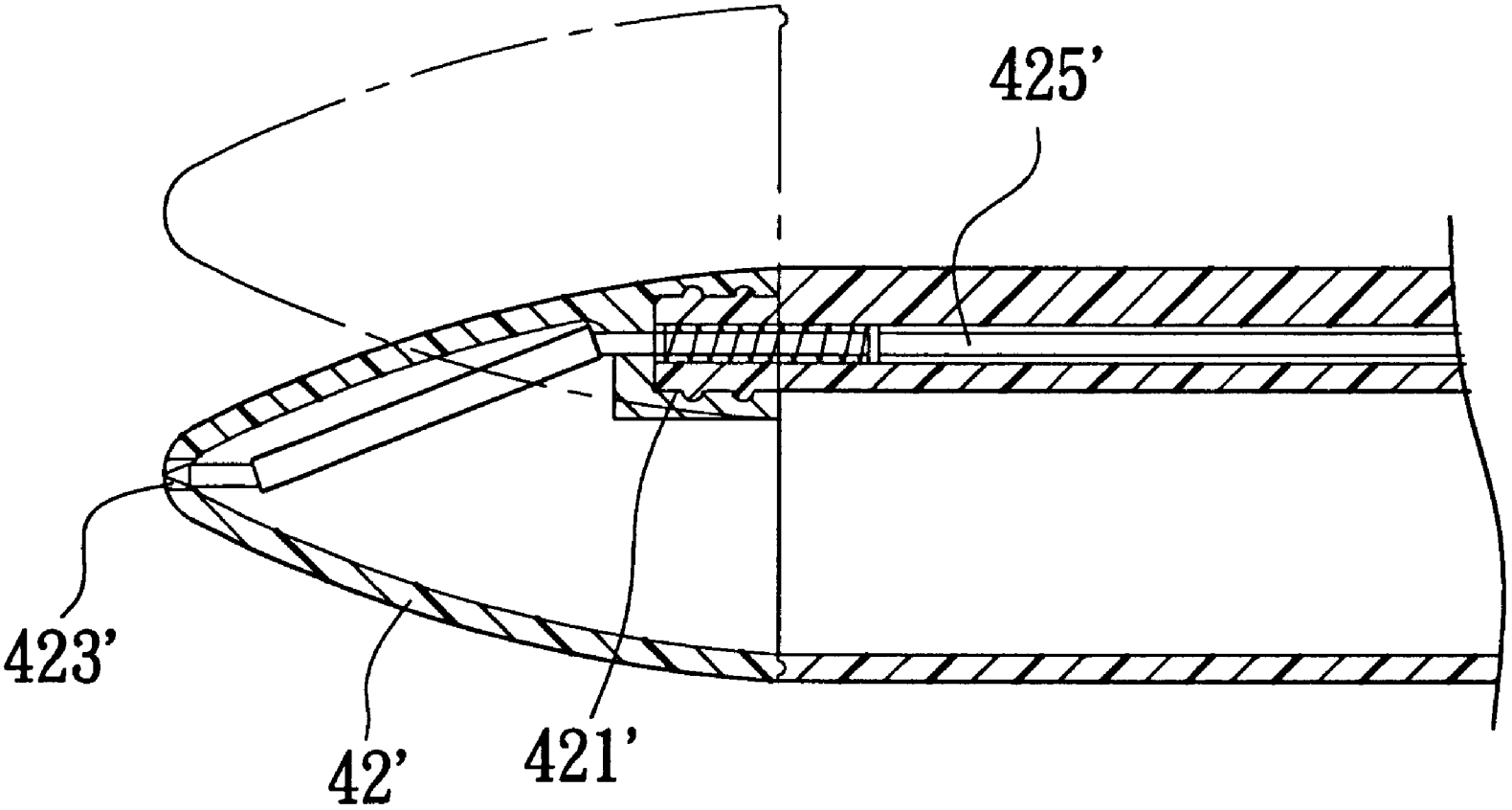
FIG. 4B is a fragmentary sectional view of a front cap and a pen barrel of the seventh preferred embodiment of the invention.

Referring to FIG. 4B, in the seventh preferred embodiment, a front section of the writing instrument 425' may be configured to pass through the pivot hole 421' and a bent through tip hole 423' of the front cap 42'.

A major advantage of the pen of the present invention is that the front cap of the pen is openable to permit access to the interior of the barrel body for storage or removal of the eyeglasses, while the rear cap is mounted fixedly to the barrel body. Compared with the prior art, which has a rear cap that is openable to allow access to the interior of the barrel body, arrangement of other functional accesories, such as a flashlight, is easier in terms of manufacture and assembly.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A pen comprising:

a pen barrel including a barrel body which is adapted to receive a pair of eyeglasses therein and which has an open front end for inserting said pair of eyeglasses therethrough and a rear end, and a fixed rear cap which is mounted fixedly and non-removably on and which closes said rear end of said barrel body; and a writing tip unit including an openable front cap which has a front end and a rear end that is attached to and that closes said front end of said barrel body, and a writing tip which is confined within said front cap and which extends from said front end of said front cap.

2. The pen as claimed in claim 1, wherein said rear cap is press fitted within said rear end of said barrel body.

3. The pen as claimed in claim 1, wherein said rear cap has an outer surface which is formed with an annular groove, said barrel body being sleeved on said rear cap and having an inner surface which is formed with an annular projection that engages fittingly said annular groove in said rear cap, thereby retaining said rear cap on said barrel body.

4. The pen as claimed in claim 1, wherein said rear cap is formed integrally with said barrel body.

5. The pen as claimed in claim 1, further comprising a flashlight which is mounted fixedly on said rear cap.

6. The pen as claimed in claim 1, wherein said rear end of said front cap is press fitted within said front end of said barrel body.

7. The pen as claimed in claim 1, wherein said writing tip unit is mounted rotatably on said pen barrel, and is formed with a retaining edge, said pen barrel being formed with a retaining edge that engages said retaining edge of said writing tip unit, thereby positioning said writing tip unit on said pen barrel.

8. The pen as claimed in claim 7, wherein said writing tip unit is rotatable about an axis, which is perpendicular to said pen barrel, for opening and closing said front end of said barrel body.

9. The pen as claimed in claim 7, wherein said writing tip unit is rotatable about an axis, which is parallel to said pen barrel, for opening and closing said front end of said barrel body.

10. The pen as claimed in claim 9, wherein said front cap has a rear end surface with an outer peripheral portion which is formed with a pivot hole, and an inner surface which is formed with two parallel annular grooves in communication with said pivot hole, said barrel body having a front end surface which includes an axially extending pivot pin that extends integrally and forwardly therefrom and that engages fittingly said pivot hole in said front cap, said pivot pin having an outer surface which is formed with two annular projections that engage respectively and fittingly said annular grooves in said front cap, whereby, said front cap can rotate about said pivot pin.

11. A writing instrument comprising:

a hollow body which is adapted to receive a pair of eyeglasses therein having an opening at one end, the opposite end of said hollow body having an integrally formed portion closing off the interior of said hollow body thereof; and a writing tip unit having first and second ends, said first end being connectable to said one end of said hollow body to selectively close off said opening, said writing tip further including a writing instrument protrudable from said second end, said eyeglasses being receivable within said hollow body through said opening.

12. A writing instrument as claimed in claim 11 wherein said hollow body includes another end opposite said one end, said another end being closed.

13. A writing instrument as claimed in claim 12 wherein said another end is closed by a cap fixedly secured to said hollow body.

14. A writing instrument as claimed in claim 13 wherein said cap is integrally formed with said hollow body.

15. A writing instrument as claimed in claim 11 wherein said hollow body and said writing tip are telescopically connectable.

16. A writing instrument comprising:

an elongated hollow body having first and second ends, said first end being open to enable a pair of eyeglasses to be inserted therethrough and into said hollow body, said second end including a substantially nonremovable portion closing said second end;

a writing instrument assembly having a first portion securable to said hollow body to selectively close said opening, said writing instrument assembly including a writing tip positioned remote from said first portion.

17. A writing instrument as claimed in claim 16 wherein said second end of said hollow body includes a cap secured thereto.

18. A writing instrument as claimed in claim 16 wherein said hollow body includes an integrally formed portion closing off said second end.

19. A writing instrument as claimed in claim 16 wherein said first portion of said writing instrument assembly is received within said hollow body to selectively secure said writing instrument assembly to said hollow body.

20. A writing instrument as claimed in claim 16 wherein said writing tip is movable between a first position in which said tip projects outwardly from said writing instrument assembly and a second position in which said tip is contained within said writing instrument assembly.

21. A writing instrument as claimed in claim 16 wherein said nonremovable portion is integrally formed with said hollow body.

* * * * *